US007017571B2

(12) United States Patent
Smits et al.

(10) Patent No.: US 7,017,571 B2
(45) Date of Patent: Mar. 28, 2006

(54) HEAT EXCHANGER DEVICE

(75) Inventors: Stan Smits, Weilheim (DE); Gerd Gumienny, Landshut (DE); Lutz Riefenstein, Weilheim (DE)

(73) Assignee: Convotherm Elektrogeräte GmbH, Eglfing (DE)

( * ) Notice: Subject to any disclaimer, the term of this patent is extended or adjusted under 35 U.S.C. 154(b) by 0 days.

(21) Appl. No.: 10/464,694

(22) Filed: Jun. 18, 2003

(65) Prior Publication Data

US 2004/0255925 A1 Dec. 23, 2004

(51) Int. Cl.
*A21B 1/02* (2006.01)
*F24C 15/32* (2006.01)

(52) U.S. Cl. ..... 126/21 A; 99/474
(58) Field of Classification Search ..... 126/21 A, 126/21 R, 110 R, 116 R, 39 R, 273 R; 99/474
See application file for complete search history.

(56) References Cited

U.S. PATENT DOCUMENTS 5,636,622 A * 6/1997 Urcelay Amondarain et al. ..... 126/21 R
5,915,372 A * 6/1999 Wiedemann et al. ..... 126/21 A
6,311,685 B1 * 11/2001 Bassoli et al. ..... 126/21 A

FOREIGN PATENT DOCUMENTS

DE 29800523 U1 * 5/1999
EP 0 526 768 A2 2/1993
EP 1176367 A1 * 1/2002
IT 1220069 * 6/1990

* cited by examiner

*Primary Examiner*—Josiah C. Cocks
(74) *Attorney, Agent, or Firm*—Ohlandt, Greeley, Ruggiero & Perle, L.L.P.

(57) ABSTRACT

A heat exchanger device for a cooking appliance includes a burner arranged in a combustion chamber. The burner is connected by a feeding pipe to a mixing device which prepares a gas/air mixture necessary for the combustion and feeds it to the burner. The mixing device is connected to the burner in a gastight manner additional air is prevented from flowing in. The combustion chamber is formed by an enlargement of a heat exchanger pipe which, starting from the combustion chamber, spirally surrounds the fan wheel which provides forced circulation of the treatment medium. The heat exchanger pipe is also wound around the combustion chamber.

13 Claims, 3 Drawing Sheets

HEAT EXCHANGER DEVICE

BACKGROUND OF THE INVENTION

1. Field of the Invention

The present invention relates to a heat exchanger device in a gas-heated apparatuses used for the heat treatment of foodstuffs, the heat exchanger device having a fan wheel for the forced circulation of a treatment medium, a gas burner and at least one heat exchanger pipe surrounding the fan wheel.

2. Description of the Related Art

A heat exchanger apparatus of this type is disclosed in EP 0 526 768 B1. The burner therein is designed as a Bunsen burner and comprises a venturi pipe into which gas from a gas nozzle is blown. Air is entrained in the venturi pipe on account of the distance between the venturi pipe and the gas nozzle, so that a certain premixing of air and gas occurs. In this case, the burner is arranged upstream of the heat exchanger pipe, with the result that the relatively long flame which leaves the burner penetrates into the heat exchanger pipe and in the process also sucks up secondary air. A disadvantage of this design is the fact that a very long flame is produced which requires a first, rectilinear section of the heat exchanger pipe, if this flame is to be formed in an exact manner. In addition, a considerable noise is produced at the two suction points for air. When this apparatus is used for the heat treatment of foodstuffs, the noise causes a considerable annoyance in the rooms where appliances of this type are installed. Furthermore, this type of burner design requires continuous pressure monitoring of both the air pressure and the gas pressure and monitoring of the quantities fed in, which necessitates an extensive regulating device. Since this prior art device requires a rectilinear heat exchanger pipe section which is as long as possible for receiving the comparatively long flame and requires an air chamber having raised air pressure for supplying the primary and secondary combustion air, the burner is arranged at a relatively large distance from the fan wheel to accommodate these requirements. Accordingly, the hottest point of the heat exchanger apparatus in which the burner flame is situated does not lie directly next to the fan wheel and this part of the heat exchanger apparatus is not acted upon directly by the medium flow produced by the fan wheel.

SUMMARY OF THE INVENTION

The object of the invention is to design a heat exchanger device for use in a gas-heated apparatus for the heat treatment of foodstuffs such that the noise level during operation of the burner is reduced, the outlay required for regulating technology is reduced, and the heat transfer to the treatment medium circulated by the fan wheel is improved.

Taking the prior art heat exchanger device described above as a starting point, the present invention achieves this object by connecting the burner directly to a mixing device which mixes gas and combustion air for setting the ratio of the gas/air mixture necessary for combustion. The mixing device includes a fan which conveys the gas/air mixture, which is ready for combustion, under pressure into the burner. After combustion has taken place, the combusted gas is conveyed into the heat exchanger pipe which is connected to the burner in a gastight manner.

In this design, the gas/air mixture is premixed ready for combustion and conveyed into the burner. Accordingly, the dual air induction, namely the induction of primary air at the venturi pipe and the induction of secondary air at the beginning of the flame and of the heat exchanger pipe, as required in the prior art device, is rendered superfluous by the present invention. The present invention therefore avoids the main cause of noise production in the prior art devices. Since the burner according to the invention is also connected to the heat exchanger pipe in a gastight manner, it is situated in a sealed combustion chamber which further damps the production of noise which arises during combustion. Since only the coordination of the gas and combustion air in terms of volume needs monitoring, the outlay for the regulation and therefore for the regulating device are reduced by use of the mixing device. The complete pre-mixing of the gas/air mixture required for combustion permits the formation of a plurality of small flames instead of one large flame, thus making it possible not only to damp the production of noise, but also to realize a greater power for the burner relative to the space taken up.

An initial region of the heat exchanger pipe may be enlarged in diameter in the region of the combustion chamber for accommodating the burner, thereby providing a particularly large surface area of the hottest region of the heat exchanger device, which improves the efficiency of the heat exchanger.

The burner may be designed as a pipe which is closed at the end and has gas outlet openings distributed on the circumference to burn as much gas as possible using the burner, as a result of which a very large number of outlet openings and therefore a very large number of burning points can be provided on a relatively small burner surface area. A correspondingly large amount of gas can then flow out of these many gas outlet openings distributed on the circumference and can be burned, enabling a high heating power to be obtained with a relatively small burner.

The axes of the gas outlet openings are preferably perpendicular to the burner longitudinal axis. In spite of the arrangement of a large number of gas outlet openings and the associated formation of a large number of flames, this arrangement prevents these flames from interfering with one another. However, there may be spatially induced conditions which necessitate a different formation of the flames. Accordingly, the axes of the gas outlet openings may be inclined obliquely at an acute angle with respect to the burner axis in the direction of flow.

So that the heat can be utilized as well as possible, the combustion chamber may be arranged essentially in the tangential direction with respect to the fan wheel. Furthermore, at least one section of the heat exchanger pipe spans a radially outer side of the combustion chamber such that the hotter combustion chamber lies proximate the fan wheel. This arrangement facilitates heat exchange and provides adequate cooling for the combustion chamber. Winding at least one section of the heat exchanger pipe around the combustion chamber enables that side of the combustion chamber which faces away from the fan wheel and has a very high temperature to heat up this section of the heat exchanger pipe again, which section has already been greatly cooled, providing a better utilization of the heat which is produced.

The heat exchanger pipe may wind a number of times around the fan wheel and the combustion chamber, at least one following winding being at least in some sections at a larger radial distance from the fan wheel axis than a preceding winding. This arrangement makes particularly good use of that space in the cooking appliance which accommodates the fan wheel because the heat exchanger pipe is wound around the fan wheel and the combustion chamber essentially in the manner of a spiral, that is to say at least in some sections, at an increasing distance from the fan wheel axis, and very good utilization of the space can therefore be achieved.

The combustion chamber is of L-shaped design having a short limb and a long limb. A free end of the short limb is an open end which surrounds an opening in a wall of the apparatus for the heat treatment and is fastened to the wall. The long limb is arranged tangentially with respect to the fan wheel. If the burner together with part of a feeding pipe for the ready gas/air mixture forms an L-shaped constructional unit, which matches the shape of the combustion chamber, and is fastened in the wall of the apparatus for the heat treatment, then the installation of the burner in the combustion chamber is thereby ensured in a particularly simple manner.

The heat exchanger device may include two fastening points to the apparatus for the heat treatment. One fastening point is formed between a wall in the cooking appliance and combustion chamber and the second fastening point is formed between that end of the heat exchanger pipe which emerges from the apparatus for the heat treatment and a housing wall of the apparatus for the heat treatment. In this arrangement, the heat exchanger device is in a position to allow the thermal expansions which occur during operation in a largely stress-free manner. It is particularly advantageous if the fastening points are arranged in close vicinity to each other, as a result of which the entire heat exchanger device can follow virtually without restriction the thermal expansions which occur.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
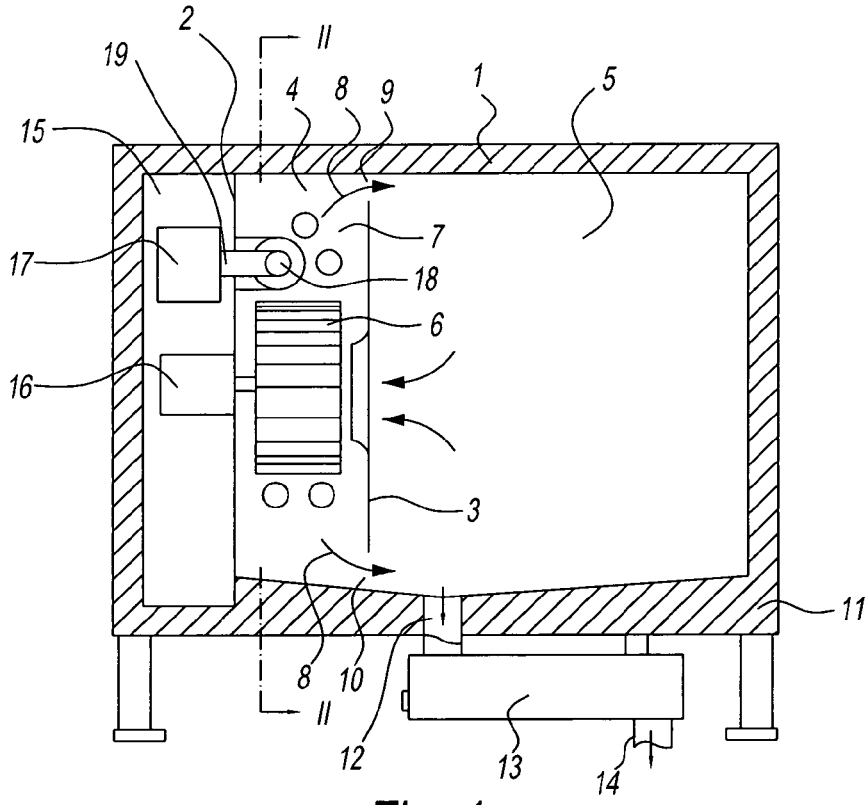
FIG. 1 is a sectional view of an apparatus for the heat treatment of foodstuffs.

An apparatus for the heat treatment of foodstuffs is referred to as a cooking appliance in the following text. The cooking appliance according to the present invention has a housing 1 which includes a customary front covering (not illustrated) and door. The housing further includes a partition 2 which divides the housing into sections which are separated from one another in a sealed manner. In the one section, a further partition 3 separates a space 4 from a space 5. The space 4 accommodates a fan wheel 6 and a heat exchanger device 7 while the space 5 is used as a cooking space for receiving the foodstuffs to be treated. Steam is introduced into the space 4 by a steam generator (not illustrated), thus producing a steam/air mixture which is blown by the fan wheel 6 in accordance with the arrows 8 through slots 9 and 10 in the partition 3 into the cooking space. This steam/air mixture is heated up by the heat exchanger device 7. A floor 11 of the cooking space 5 opens into an outflow 12 which receives an outflow of condensation and provides an outlet for grease and cleaning fluids. This outflow 12 opens into a mixing condenser 13 which is used for condensing the vapors which flow off and a discharge line 14.

Figure 2:
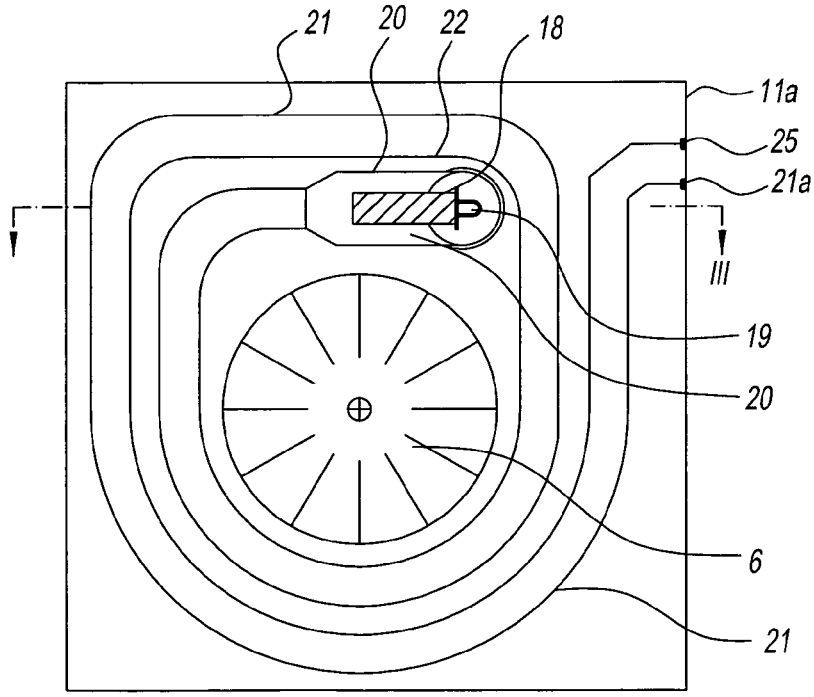
FIG. 2 is another sectional view of the apparatus of FIG. 1 along the line II—II.
Figure 3:
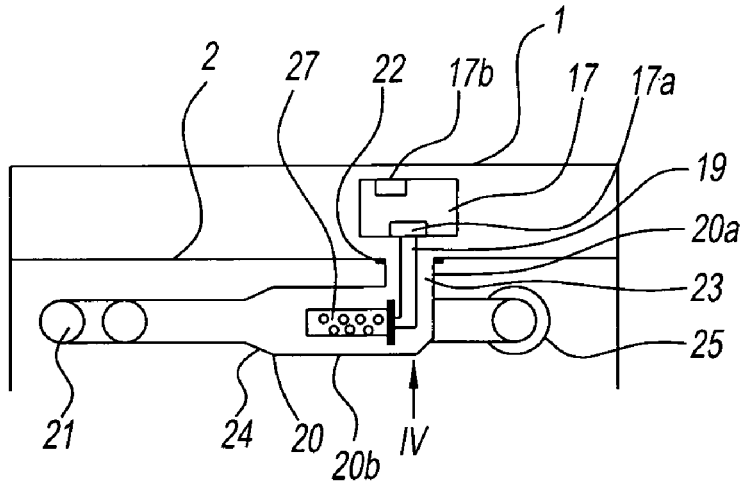
FIG. 3 is a partial sectional view along the line III—III in FIG. 2.

The section on the other side of the partition 2 is a space 15 which is hermetically separated from spaces 4, 5 by the partition 2. Space 15 houses control and regulating elements (not illustrated), a driving motor 16 for the fan wheel 6, and a mixing device 17 for a gas-operated burner 18 of the heat exchanger device 7. The burner 18 is connected by a feeding pipe 19 to the mixing device 17. The heat exchanger device 7 also includes a combustion chamber 20 which is adjoined by a heat exchanger pipe 21 which winds not only around the fan wheel 6, but also around the combustion chamber 20, the distance of the individual pipe sections from the center of the fan wheel 6 increasing with each winding. The combustion chamber 20 extends in a tangential direction with respect to the fan wheel 6 proximate the radially outer side of the fan wheel 6 and is L-shaped. A shorter limb 20*a* of the combustion chamber 20 is fastened to the partition 2 by a flange 22 and surrounds an opening 23 in the partition 2. A longer limb 20*b* of the combustion chamber 20 holds the burner 18, which is connected to the mixing device 17 via the feeding pipe 19, which is also L-shaped. The L-shaped design of the combustion chamber 20 and of the feeding line 19, on which the burner 18 sits, enables the burner 18 to be threaded in a simple manner into the combustion chamber 20. One end of the heat exchanger pipe 21 is connected to the combustion chamber 20 by a transition element 24 (see FIG. 3). The burner 18 is connected to the combustion chamber 20, and thus the heat exchanger pipe 21, by a gas-tight connection 23*a*, as shown, for example, in FIGS. 3 and 4. The other end 21*a* of the heat exchanger pipe 21 is connected to a housing wall 11*a* by a flange 25. Flanges 22 and 25 are arranged proximate each other. As can be seen in particular from FIG. 2, these two fastening points, i.e., flanges 22 and 25, are at a relatively small distance from each other, such that the entire heat exchanger pipe is free from fastening points and is thus not subject to any obstructions by additional fastening points during the thermal expansion which occurs during operation.

The mixing device 17 comprises a fan 17*a* (shown schematically) and metering devices 17*b* for setting the gas/air mixture which is required for combustion and which, in contrast to the heat exchanger devices of the prior art, is fed to the burner 18 in the ratio required for the combustion, i.e. is completely premixed. An additional feeding in of secondary air is not required, which has a favorable effect on the production of noise.

Figure 4:
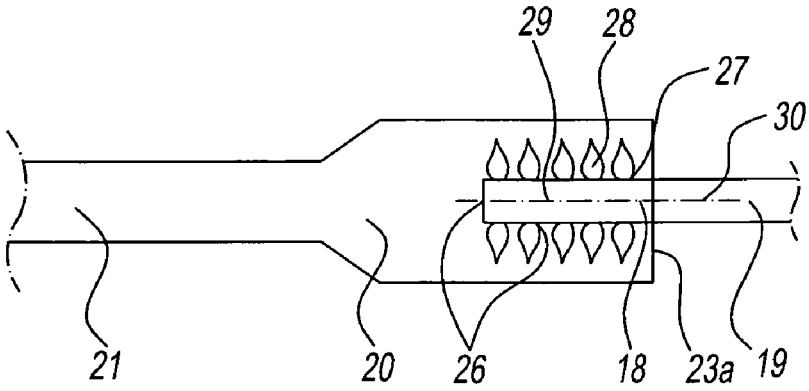
FIG. 4 is an enlarged illustration of the region denoted by IV in FIG. 3.

As is apparent from FIG. 4, the burner 18 comprises a pipe with a closed end 26, which is approximately half the length of the combustion chamber 20. The circumference of the burner 18 is provided with openings 27 from which the gas/air mixture emerges. After ignition, the gas/air mixture emerging from the openings 27 form a plurality of flames 28 situated next to one another. The axes 29 of the openings 27, which are perpendicular to the burner longitudinal axis 30.

Figure 5:
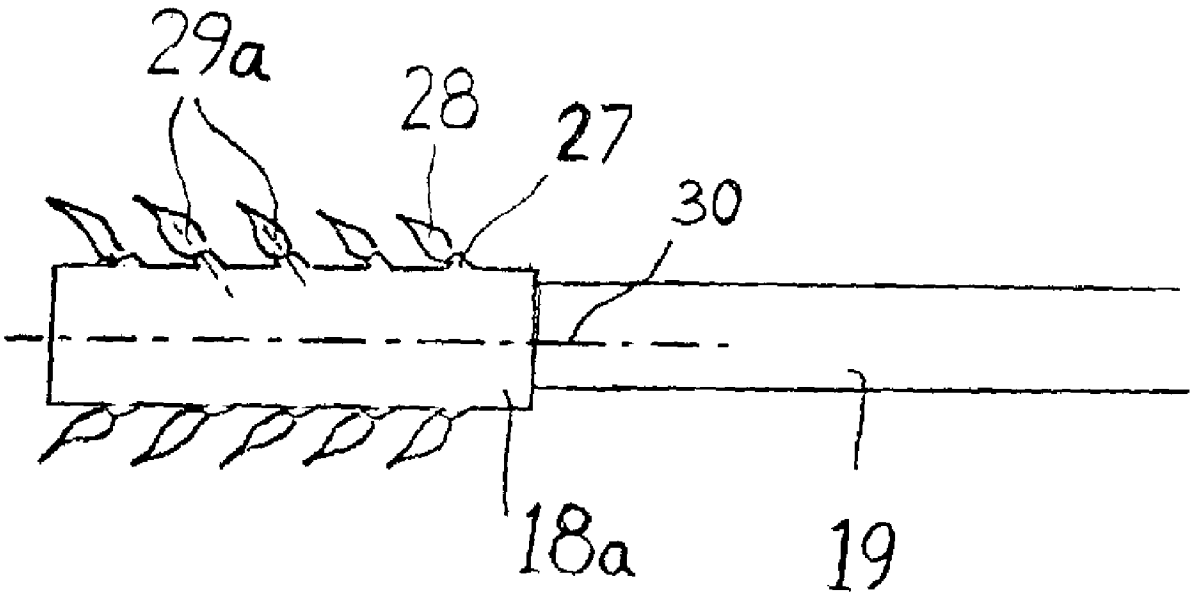
FIG. 5 is a sectional view of an alternative embodiment of a burner for the apparatus of FIG. 1.

FIG. 5 shows an alternative embodiment in which axes 29*a* of the openings 27 in a burner 18*a* are inclined forwards at an acute angle in the direction of flow of the gas.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A heat exchanger device for a gas-heated cooking appliance, comprising:

a fan wheel for inducing circulation of a treatment medium in a cooking appliance, said fan wheel having a fan wheel axis of rotation;

a gas burner;

at least one heat exchanger pipe surrounding said fan wheel and connected to said burner by a gas-tight sealed connection, said at least one heat exchanger pipe comprising first and second ends, an initial region at said first end defining a combustion chamber for accommodating said burner that is enlarged in diameter relative to said at least one heat exchanger pipe, said combustion chamber having a longitudinal axis extending essentially in a tangential direction relative to said fan wheel and being arranged proximate said fan wheel, said burner having a longitudinal axis extending parallel to the longitudinal axis of said combustion chamber, wherein said burner comprises a pipe section having a closed end and gas outlet openings distributed on a circumference of said pipe section, and wherein each of said gas outlet opening defines an axis in a direction of flow in said each of said gas outlet openings, said axes of said gas outlet openings being inclined obliquely at an acute angle with respect to a longitudinal axis of said burner; and a mixing device for setting a ratio of a gas/air mixture required for combustion, said mixing device including a fan for conveying the gas/air mixture to said burner and, after combustion, into said at least one heat exchanger pipe.

2. The heat exchanger device of claim 1, wherein said combustion chamber extends essentially in a tangential direction relative to said fan wheel and said combustion chamber is arranged proximate said fan wheel, and wherein at least a section of said heat exchanger pipe spans a radially outer side of said combustion chamber relative to said fan wheel.

3. The heat exchanger device of claim 1, wherein said heat exchanger pipe is wound around said fan wheel and combustion chamber a number of times thereby forming a plurality of windings, at least one following winding of said windings being at least in some sections at a larger radial distance from said fan wheel axis than a preceding one of said windings.

4. The heat exchanger device of claim 1, wherein said combustion chamber is L-shaped and comprises a short limb and a long limb, said short limb having a free end arranged for surrounding an opening in a wall of the cooking appliance and is fastenable to the wall, and said long limb being arranged tangentially with respect to said fan wheel.

5. The heat exchanger device of claim 4, further comprising a feeding pipe for feeding the gas/air mixture to said burner, wherein said feeding pipe and said burner together form an L-shaped constructional unit which matches the L-shape of said combustion chamber, said feeding pipe being fastenable in the opening of the wall of the cooking appliance.

6. The heat exchanger device of claim 1, wherein each of said first and second ends of said at least one heat exchanger pipe comprising a fastening point for connection to the cooking appliance, one of said fastening points is connectable between a wall in the cooking appliance and said combustion chamber and the other fastening point is connectable between that said second end of said heat exchanger pipe and a housing wall of the cooking appliance.

7. The heat exchanger device of claim 6, wherein said fastening points are arranged proximate each other, thereby allowing thermal expansion of said at least one heat exchanger pipe.

8. A heat exchanger for a gas-heated cooking appliance, comprising:

a fan wheel for inducing circulation of a treatment medium in a cooking appliance, said fan wheel having a fan wheel axis of rotation;

a gas burner having a pipe section having a closed end and gas outlet openings distributed on a circumference of said pipe section;

at least one heat exchanger pipe surrounding said fan wheel and connected to said burner by a gas-tight sealed connection; and a mixing device for setting a ratio of a gas/air mixture required for combustion, said mixing device including a fan for conveying the gas/air mixture to said burner and, after combustion, into said at least one heat exchanger pipe, wherein each of said gas outlet opening defines an axis in a direction of flow in said each of said gas outlet openings, said axes of said gas outlet openings being inclined obliquely at an acute angle with respect to a longitudinal axis of said burner.

9. A gas-heated cooking appliance, comprising:

a housing having walls defining an interior and a partition wall dividing the interior of said housing into first and second sections;

a heat exchanger device including a fan wheel for inducing circulation of a treatment medium in said first section of said cooking appliance, said fan wheel having a fan wheel axis of rotation, a gas burner, at least one heat exchanger pipe surrounding said fan wheel and defining a combustion chamber connected to said burner by a gas-tight sealed connection, and a mixing device for setting a ratio of a gas/air mixture required for combustion, said mixing device including a fan for conveying the gas/air mixture to said burner and then, after combustion, into said at least one heat exchanger pipe;

said combustion chamber being L-shaped and comprising a short limb and a long limb, said short limb having a free end fastened to said partition wall such that said free end surrounds an opening defined in said partition wall and said long limb being arranged tangentially with respect to said fan wheel; and a feeding pipe for feeding the gas/air mixture from said mixing device to said burner, wherein said feeding pipe and said burner together form an L-shaped constructional unit which matches the L-shape of said combustion chamber, said feeding pipe being fastened in the opening of said partition wall of the cooking appliance.

10. The cooking appliance of claim 9, wherein said at least one heat exchanger pipe comprises two ends, each of said two ends comprising a fastening point, one of said fastening points being formed between said partition wall in the cooking appliance and said combustion chamber and the other fastening point being formed between that end of said heat exchanger pipe which emerges from the cooking appliance and one of said housing walls of the cooking appliance.

11. The cooking appliance of claim 10, wherein said fastening points are arranged proximate each other, thereby allowing thermal expansion of said at least one heat exchanger pipe.

12. A heat exchanger for a gas-heated cooking appliance, comprising:

a fan wheel for inducing circulation of a treatment medium in a cooking appliance, said fan wheel having a fan wheel axis of rotation;

a gas burner having a pipe section having a closed end and gas outlet openings distributed on a circumference of said pipe section;

at least one heat exchanger pipe surrounding said fan wheel and defining a combustion chamber connected to said burner by a gas-tight sealed connection; and a mixing device for setting a ratio of a gas/air mixture required for combustion, said mixing device including a fan for conveying the gas/air mixture to said burner and, after combustion, into said at least one heat exchanger pipe, wherein said combustion chamber extends essentially in a tangential direction relative to said fan wheel and said combustion chamber is arranged proximate said fan wheel, and wherein at least a section of said heat exchanger pipe spans a radially outer side of said combustion chamber relative to said fan wheel.

13. A gas-heated cooking appliance, comprising:

a housing having walls defining an interior and a partition wall dividing the interior of said housing into first and second sections;

a heat exchanger device including a fan wheel for inducing circulation of a treatment medium in said first section of said cooking appliance, said fan wheel having a fan wheel axis of rotation, a gas burner, at least one heat exchanger pipe surrounding said fan wheel and defining a combustion chamber connected to said burner by a gas-tight sealed connection, and a mixing device for setting a ratio of a gas/air mixture required for combustion, said mixing device including a fan for conveying the gas/air mixture to said burner and then, after combustion, into said at least one heat exchanger pipe, wherein said combustion chamber extends essentially in a tangential direction relative to said fan wheel and said combustion chamber is arranged proximate said fan wheel, and wherein said combustion chamber is L-shaped and comprising a short limb and a long limb, said short limb having a free end fastened to said partition wall such that said free end surrounds an opening defined in said partition wall and said long limb being arranged tangentially with respect to said fan wheel; and a feeding pipe for feeding the gas/air mixture from said mixing device to said burner, wherein said feeding pipe and said burner together form an L-shaped constructional unit which matches the L-shape of said combustion chamber, said feeding pipe being fastened in the opening of said partition wall of the cooking appliance.

* * * * *